United States Patent [19]

Lundgren

[11] Patent Number: 4,722,522

[45] Date of Patent: Feb. 2, 1988

[54] EXERCISE MACHINE

[76] Inventor: John Lundgren, 3263 Torringford St., Torrington, Conn. 06790

[21] Appl. No.: 3,504

[22] Filed: Jan. 15, 1987

[51] Int. Cl.[4] ..... A63B 21/06

[52] U.S. Cl. ..... 272/117; 272/134; 272/DIG. 4

[58] Field of Search ..... 272/117, 118, 123, 134, 272/DIG. 4

[56] References Cited

U.S. PATENT DOCUMENTS

| | | | |
|---|---|---|---|
| 684,688 | 10/1901 | Herz | 272/117 |
| 3,112,108 | 11/1963 | Hanke | 272/134 X |
| 3,573,865 | 4/1971 | Annas | 272/117 |
| 4,098,502 | 7/1978 | Faust | 272/117 X |
| 4,211,403 | 7/1980 | Coffaro et al. | 272/134 |
| 4,239,210 | 12/1980 | Lambert, Jr. | 272/118 |
| 4,357,010 | 11/1982 | Telle | 272/118 X |
| 4,546,971 | 10/1985 | Raasoch | 272/117 X |
| 4,563,003 | 1/1986 | Bugallo et al. | 272/118 |
| 4,598,907 | 7/1986 | Ross | 272/117 |
| 4,600,189 | 7/1986 | Olschansky et al. | 272/118 |
| 4,603,855 | 8/1986 | Sebelle | 272/117 |
| 4,627,614 | 12/1986 | De Angeli | 272/117 |

*Primary Examiner*—Richard J. Apley
*Assistant Examiner*—Robert W. Bahr
*Attorney, Agent, or Firm*—McCormick, Paulding and Huber

[57] ABSTRACT

An operating bar can be moved between limit positions at least 180° apart, and a sprocket on the axis of motion carries a chain connected to a lever for exerting a near constant reaction force or torque. A bellcrank on the same axis carries weights that provide a variable force or torque on the movable bar. The user can assume one position to move the bar in a biceps exercise mode and another position to move the bar in a triceps exercise mode. The bellcrank has two pins to support weights in two angularly related positions to provide a desired force variation for each such exercise mode.

14 Claims, 11 Drawing Figures

EXERCISE MACHINE

BACKGROUND OF THE INVENTION

This invention is related to multi-functional exercise machines wherein a user may exercise different portions of his or her body as a result of taking different positions relative to the machine.

Exercise machines using the resistance afforded by weights on lever arms to require the use of different muscles in lifting exercises are, of course, well known in the art. However, such prior art systems do not generally provide for the subject to exercise many different muscles with a single machine simply by shifting his position relative to a movable operating bar or lever. In prior art systems the movable operating bar or lever can be given different degrees of resistance to movement, but such machines do not provide the capability for varying the resistive forces through a single range of operating bar or lever movement that two different positions for the subject, relative to the bar or lever, permit the machine to be operated in two distinct modes for exercising distinctly different muscles of the subject or user. While the prior art does show means for varying the resistive forces on an operating bar or lever, prior art merely teach the basic concept of providing an actuating bar mechanism rotably mounted in a frame so that a pulley mechanism can be coupled to vertically moveable weight elements in order to provide a resistive force for the bar.

Prior art exercising machines also include pivotally hung weights that are raised from a neutral or hanging position through an arc of about 90° to an elevated position. However, these machines do not provide the degree of flexibility required for "programming" a desired change of resistive force through a range of travel such that the apparatus can be used to exercise both bicep and tricep muscles in a single exercise machine as disclosed herein.

SUMMARY OF THE INVENTION

The exercise machine disclosed herein includes a frame that defines two longitudinally spaced pivot points, one for an operating bar and the second for a weight lever that extends from adjacent a rear portion of the frame past a first pivot axis for the operating bar and includes a free end portion that is useful in achieving elementary exercise maneuvers such as a leg press, bench press, military press, and which also includes capability for an "upright" rowing maneuver.

The machine in accordance with the present invention further includes a sprocket, drum or pulley system rotatable on the same axis as that of the operating bar, or at least on an axis coupled or drivingly connected therewith. The operating bar is maneuverable from or between first and second positions that are spaced from one another by approximately 180° and through an intermediate position generally half way between the first and second bar positions. The weight lever is pivotably mounted in the frame for movement on the second axis from a first, or rest position to a second, raised or elevated position. The lever includes a post for supporting conventional weights.

A chain or cable is wrapped around at least a segment of the sprocket, drum or pulley and has a free end connected to the lever so that rotation of the operating bar in one direction raises the lever from its rest position toward the elevated position. The chain can also be used to hold the weight lever in an elevated position for use in shrugs and seated shoulder presses.

In order to exercise the tricep muscles the user occupies a seat provided for this purpose below and rearwardly of the first axis and places his elbows on a horizontally extending shelf parallel to and slightly below the first axis so that pads on the bar can be pushed with the hands or forearms in a maneuver whereby the weight lever is moved from an intermediate position toward its elevated position as the operating bar is moved from an upright position intermediate its first and second positions forwardly toward the second position through an arc of 135° . The operating bar comprises a U-shaped member and the pads fitted on the legs of the U. The U-shaped member is pivotably pivotally connected to the same shaft on which the sprocket is provided. The sprocket includes a crank arm having angularly spaced pins referred to herein as a bicep and a tricep pin, which pins are provided with weights depending upon the exercise maneuver being accomplished. In order to exercise the biceps the user assumes a position where he faces the seat and he is forward of the first axis again with his elbows on the shelf. The arms grip the pads on the U-shaped operating bar so as to pull the bar toward him and above his head from the first through the intermediate to the second position for the bar.

It is an important feature of the present invention that in the first position of the operating bar the bicep pin is provided generally below the axis of the sprocket, and in the intermediate position of the U-shaped bar the tricep pin is provided generally below the axis of the bar. This arrangement provides the desired gradual increase in reactive force as the user operates the bar in two different modes to exercise his tricep or his bicep muscles. The presence of two pins on the bell crank associated with the sprocket also provides a convenient means for placing smaller weights on the pin not ordinarily used in a particular maneuver to achieve a counterweight effect and to thereby reduce the resistance to movement provided by the various wieghts in the exercise machine itself.

DETAILED DESCRIPTION

Figure 1:
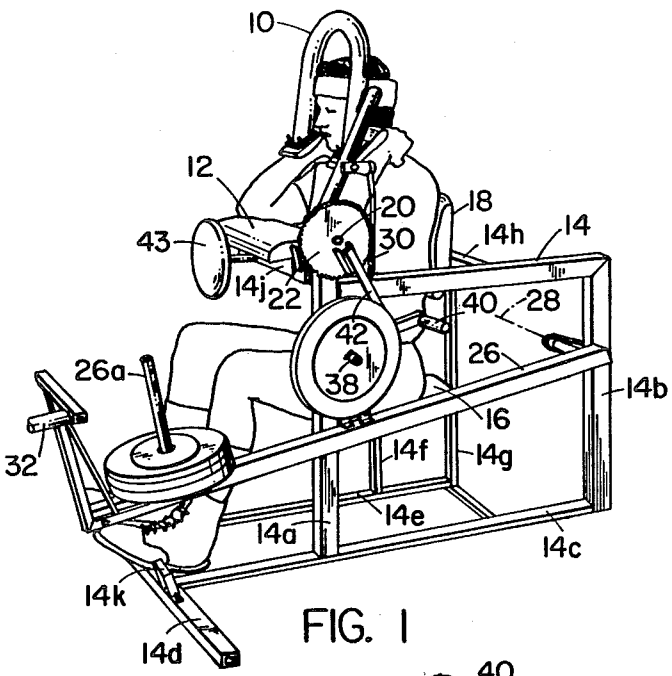
FIG. 1 is a perspective front quartering view of an exercise machine incorporating the present invention.
Figure 2:
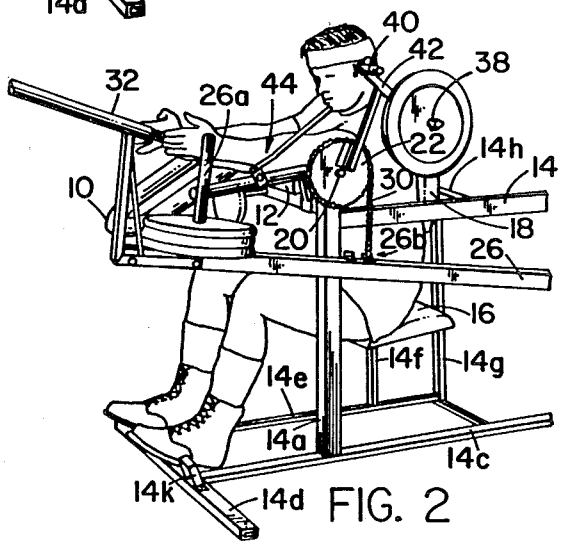
FIG. 2 is a view similar to FIG. 1 but illustrates the operating bar and associated mechanism in a second position beyond that of FIG. 1.

FIGS. 1 and 2 illustrate a person utilizing the apparatus of the present invention in a mode for exercising the tricep muscles. In this mode of operation an operating bar is moved from the intermediate position depicted in FIG. 1 to a second position as illustrated in FIG. 2, such motion of the operating bar being achieved by the user moving his forearms from the position of FIG. 1 to that of FIG. 2 while resting his elbows on a horizontally extending shelf 12 provided for this purpose in the apparatus.

Figure 3:
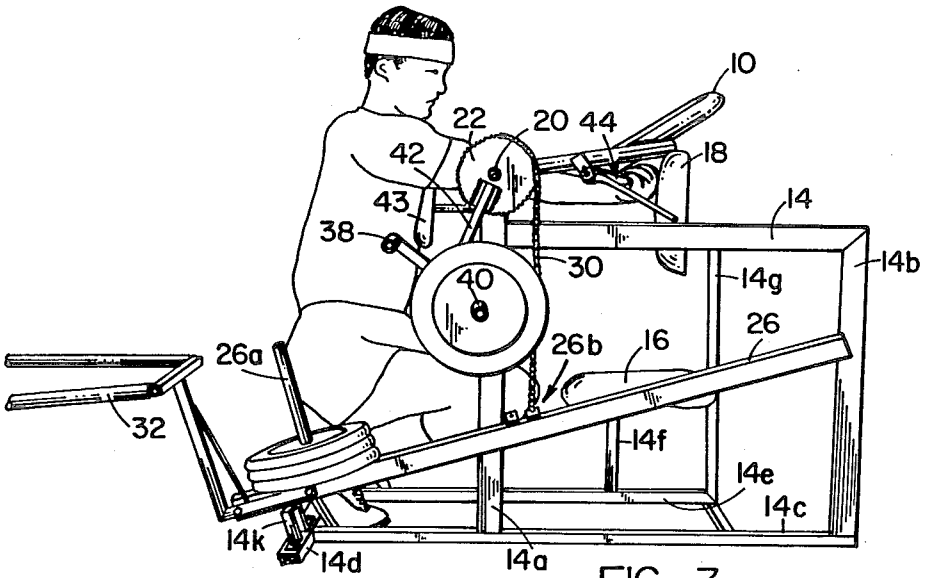
FIG. 3 is a perspective view of the machine illustrated in FIGS. 1 and 2 but with the user starting from a first position wherein the operating bar is positioned rearwardly of that depicted in FIG. 1.
Figure 4:
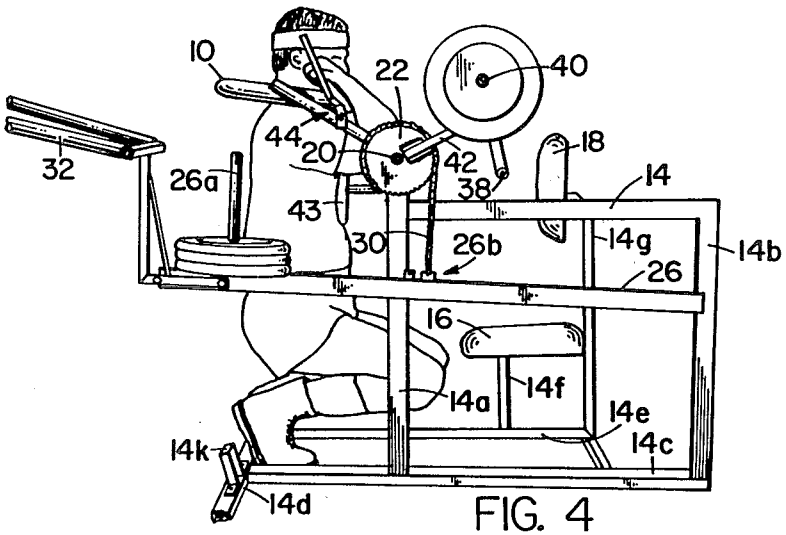
FIG. 4 is a view similar to FIG. 3 but illustrating the bar in or near the second position illustrated for it in FIG. 2.

FIGS. 3 and 4 illustrate the same apparatus of FIGS. 1 and 2 save for the configuration of the weights on a bell crank to be described, the FIGS. 3 and 4 configuration being utilized to exercise the bicep muscles while the person is positioned in a squatting or seated position opposite the position illustrated in FIGS. 1 and 2.

Other exercise modes can be accomplished with the apparatus and these are illustrated in FIGS. 7 through 11, and will be referred to hereinafter in greater detail.

Referring now to FIGS. 1 through 6 of the drawings the apparatus in its presently preferred form comprises a fixed frame 14, which frame includes an upper horizontally extending member welded to uprights **14*a* and 14*b* which uprights are in turn supported on a base member 14*c* that is adapted to rest on the ground as s hown. Actually the base 14*c* is of T-shape having a front cross bar 14*d* that adds stability to the upright rectangular frame 14, and which cross bar 14*d* is also connected to a second base member 14*e* located parallel to and in spaced relationship to the base member 14*c***.

Figure 6:
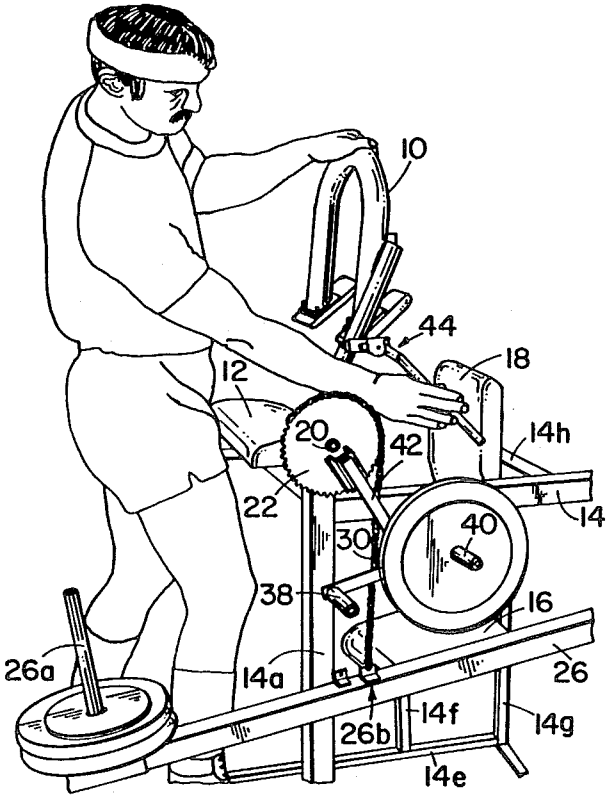
FIG. 6 illustrates the operating bar being moved to an intermediate position preparatory to initiating the exercise depicted in FIGS. 1 and 2.

Still with reference to the fixed frame a seat means is defined in the frame and more particularly on the parallel base member **14*e* as best shown in FIG. 4 comprises a platform 16 and a backrest 18 which seat and backrest are supported by uprights 14*f* 14*g*. Finally, and as best shown in FIG. 6 a cross member 14*h* is provided to further support the seat means defined by the backrest 18 and seat 16**.

Figure 5:
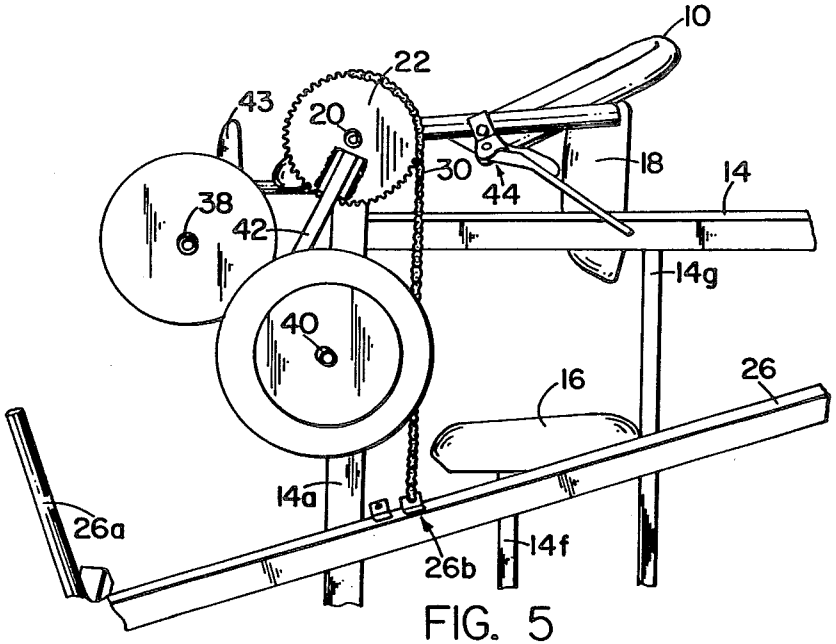
FIG. 5 shows a portion of the exercising machine illustrated in FIGS. 1 through 4, and illustrates an equilibrium position for the operating bar with weights distributed on both pins associated with the operating bar pivot.

Still with reference to the frame 14 front vertical leg **14*a* extends upwardly beyond the top of frame 14 and defines a laterally extending journal for cross shaft 20 (best shown in FIG. 5). This cross shaft defines a first pivot axis in the frame 14 and rotatably supports a sprocket 22 as well as rotatably supporting the operating bar 10. A horizontally extending shelf 12 best shown in FIG. 6 is provided just below the axis of cross shaft 20 and is provided on a cross brace 14*j* located in parallel relationship to the cross brace 14*h* for supporting the seat back 18. Still with reference to FIG. 6 the user can move or rotate the operating bar 10 from a first position as shown in FIG. 3 through an intermediate position as depicted generally in FIG. 1 and FIG. 6 to a second position illustrated in FIGS. 2 and 4. Thus, the bar 10 moves on the axis defined by cross shaft 20 and this invention relates to the configuration for this operating bar as well as the unique arrangement for providing resistive forces on the bar through the medium of sprocket 22 and a bell crank assembly providing weights in eccentric relationship to the axis of shaft 20** all as to be described hereinafter.

Figure 7:
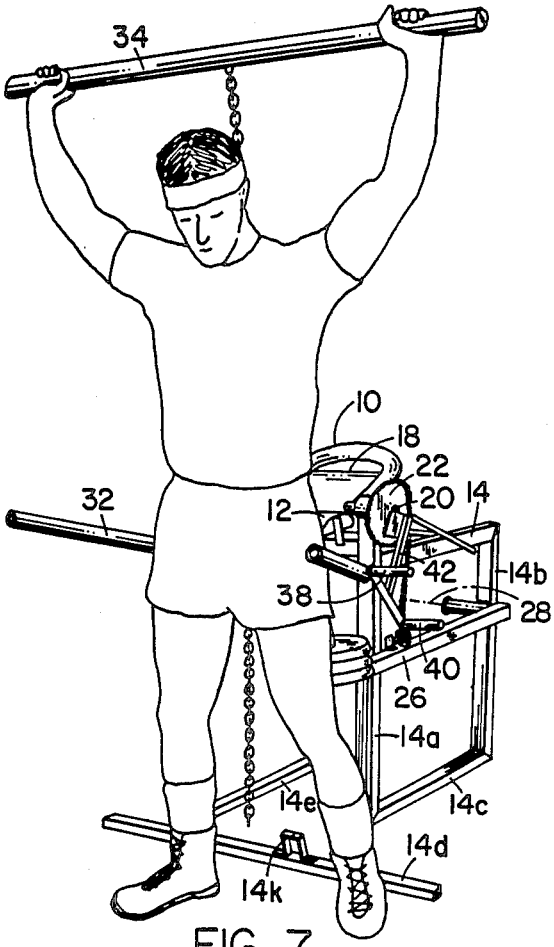
FIG. 7 is a front perspective view of the exercise machine illustrated in FIGS. 1 through 6, and also shows a chain connected to the forward end of the lever and to an overhead bar such that a so-called military press maneuver can be accomplished.

A lever 26 is pivotally provided in the frame for movement about an axis 28 defined by a journal bearing provided for this purpose on the rear leg **14*b* of the frame 14 (see FIG. 1). Lever 26 has a rest position (best shown in FIG. 3) wherein a forward or free end portion of the lever 26 is supported by the cross bar 14*d* and more particularly by a raised stop surface 14*k* provided thereon. Still with reference to the lever 26 the cantilevered free end portion also includes an upright post 26*a* which is adapted to provide a convenient support for weights (3 shown in FIG. 3 and 4 for example) such that movement of the operating bar 10 can be restricted through the medium of chain 30 provided on the sprocket 22 and connected to an intermediate portion of the lever 26 as indicated generally at 26*b* in FIG. 3. Still with reference to the lever 26 the forward or free end portion of the lever also includes a handle bar or yoke portion 32 adapted to be used to accomplish the exercise as illustrated in FIGS. 8, 9, 10 and 11. These exercises are merely performed with the aid of the handle bar assembly 32 in such a fashion that one must lift these weights provided on the post 26*a* in accomplishing these maneuvers. FIG. 7 illustrates a further use for the lever 26 whereby a military press type maneuver can be accomplished with a cross bar 34 and chain 36 connected to the cross bar 34 at one end of the chain and having the other end of the chain connected to the lever 26 at the junction between the handle bar 32 and the free end portion of the lever. While a chain is the preferred form for connecting lever 26 to sprocket 22 it will be apparent that other forms for this tensionable flexible element might be substituted for chain 30. for example a cable could be wrapped around a drum or a wheel provided in place of sprocket 22**.

In accordance with the present invention the motion of operating bar 10 can be programmed with a predetermined resistive force or torque through the combination of lever 26 and an eccentric crank assembly defining two angularly spaced radially offset pins 38 and 40 best shown in FIG. 5. Both pins 38 and 40 are provided on a crank arm 42 welded to the sprocket 22 and the pin 40 is so arranged on crank arm 42 that it will occupy a position immediately below the axis of rock shaft 20 when the operating bar 10 is in the position shown for it in FIGS. 3 and 5 and more particulary when the operating lever 26 is in the position shown for it in these views. The chain 30 is wrapped around a portion of the perifery of sprocket 22 and has its free end portion connected to the lever 26 as indicated generally at **26*b*. The lever 26 actually has several attachment points for the free end of chain 30 and this geometry provides a degree of fine adjustment for the constant force exerted by the weights on lever 26 through the chain 30 resulting in a torque of relative constant value around the axis of cross shaft 20**.

Coupled with this constant torque on sprocket 22 and cross shaft 20 eccentrically mounted weights provided on the pins 38 and 40 provide a force which varies depending upon the angular position of crank arm 42 relative the axis of cross shaft 20. With weight provided on pin 40 the apparatus of the present invention is especially suited to performing the exercise illustrated in FIGS. 3 and 4. This exercise develops the bicep muscles of the user and pin 40 will be referred to herein as the bicep pin, and it will be noted that the weight on this pin 40 moves from a position generally directly below the axis of cross shaft 20 (FIG. 3) to a position where this pin 40 and its associated weight are raised to the position shown in FIG. 4. The force exerted by the weight provided on bicep pin 40 exerts little or no torque in the FIG. 3 position and the torque increases as the user approaches the position shown for the operating bar 10 in FIG. 4. It will be apparent then that one can vary the resistive forces provided by the apparatus shown simply by providing more or less weight on the pin 40 or the post 26*a*. A fine adjustment can be made by the user if a weight is placed on the pin 38 as suggested in FIG. 5. This latter possibility will permit the user to provide a counterweight on the crank arm 42 tending to lessen the resistive force of the weight on the bicep pin 40 during the maneuver illustrated in FIGS. 3 and 4.

Another important feature of the present invention is the location for the axis of cross shaft 20 relative to the users bpdy position. More particulary, it will be noted that the axis of the shaft 20 is located at or close to the pivot joint for the users elbow. This positioning of the user is assured by the location of laterally extending shelf 12 on its support 14*j* of the frame. As a further aid in positioning the user a chest engaging pad 43 is provided so that the user will assume a proper position for initiating the bicep mode of operation as suggested in FIG. 3. The pad is illustrated in FIG. 1 wherein the operator has taken a position on the seat means for purposes of utilizing the same bar 10 in developing his tricep muscles.

As illustrated in FIG. 1 the initial position for the tricep mode calls for positioning the operating bar 10 in an upright or intermediate position between its first and second positions as utilized in the bicep mode of FIGS. 3 and 4. FIG. 6 illustrates one means for prepositioning the operating bar 10 for the tricep mode. A bicycle kickstand lever is provided on the operating bar as indicated generally at 44 in FIG. 6 which kickstand 44 has a lower end which is adapted to contact the top bar of fixed frame 14 for this purpose.

Referring now to the configuration of the operating bar 10 it will be apparent that the operating bar 10 has a generally U-shape with the legs of the U defining manually engageable portions that are adapted to be engaged by the users forearm in the tricep mode for use illustrated in FIGS. 1 and 3. That is, the user pushes against these pads provided for this purpose on the U-shaped operating bar 10 as illustrated in FIG. 1 causing the bar 10 to move from its intermediate position to a forward or second position as suggested in FIG. 2. The resistance to this motion is achieved by providing a weight on pin 38 referred to here as the tricep pin on eccentric crank arm 42. In the FIG. 1 position of operating bar 10 the pin 38 is provided immediately below the axis of the rock shaft 20 so that no force is exerted on the bar 10 by the weight on this pin 38. Rather, the entire force exerted on the bar 10 in the FIG. 1 position is provided due to the lever 26 and the weights provided on its weight support post 26*a*. As in the bicep mode referred to previously the tricep mode provides for movement of the weight on tricep pin 38 from a position immediately below the axis (FIG. 1) to a raised position where the weight on pin 38 is at 90° or beyond relative to this axis (see FIG. 2). Thus, the constant force exerted by the weights on post 26*a* is supplemented by the force and torque exerted by the weight on tricep pin 38 during this maneuver. Here again, the weights provided on post 26*a* of lever 26 can be removed for placement on the triceps pin 38 to provide a greater torque or resistance to movement of bar 10 at the latter portion of the travel, that is close to the FIG. 2 position.

Referring now to the operation of the exercise apparatus described above FIGS. 1 and 2 illustrate use of the apparatus in a tricep muscle development mode of operation wherein the user positions himself on the seat means provided for this purpose in the frame and utilizes cross bar 14*d* of the frame to locate his feet. The operating bar 10 will have been prepositioned to the position shown in FIG. 1 so that the user can place his forearms against the pads provided at the legs of the U-shaped bar 10 and place his elbows on the shelf 12 provided for this purpose. By pushing his forearms forwardly the user can move bar 10 from the FIG. 1 toward the FIG. 2 position with the weight provided on tricep pin 38 exerting a constantly increasing force during this maneuver.

In the bicep muscle development mode illustrated in FIGS. 3 and 4 the user positions himself oppositely relative the frame and more particularly with his chest against the chest location pad 43 and with the lever 26 in its rest position and the lever 10 in its rest position as shown in FIG. 3. The user places his elbows again on the shelf and puts his hand around the manually engageable portion of the U-shaped bar 10 as shown in FIG. 3 moving the bar 10 from the position shown through the intermediate position of FIG. 1 to a second or forward position illustrated in FIG. 4. The weight is provided on bicep pin 40 so that a constantly increasing force is provided against movement of the bar 10 such force going through a maximum value as the bar 10 is moved from the overhead or intermediate position of FIG. 1 to the final position of FIG. 4.

FIG. 7 illustrates another mode of operation of the device where the weights on bar 26 are raised through the medium of a hand held cross bar or handlebar 34 to perform a military press exercise.

Figure 8:
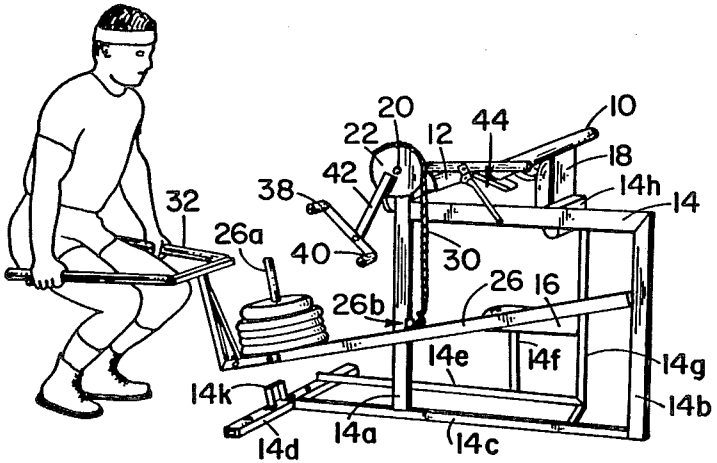
FIG. 8 is a rear quartering perspective view of the apparatus illustrated in FIGS. 1 through 6 with the handle bars at the forward end of the lever being utilized to accomplish a leg press maneuver.

FIG. 8 illustrates use of the lever 26 and the handlebar associated with it for a leg press maneuver.

Figure 9:
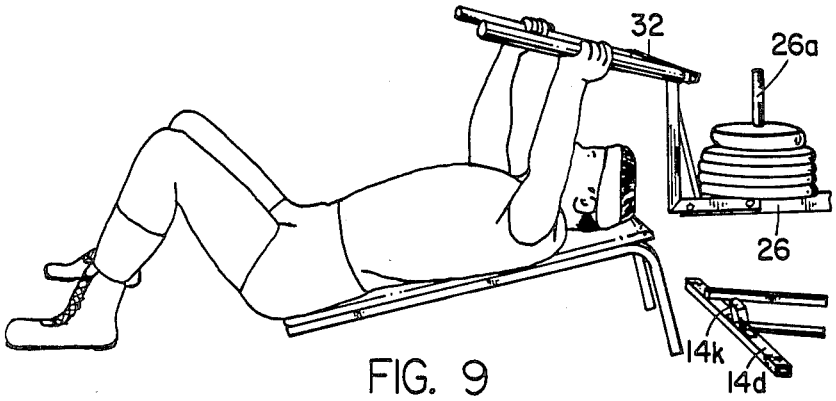
FIG. 9 is a view of the handle bar portion of the lever in an exercise machine constructed in accordance with the present invention, and illustrates a person positioned on a bench for accomplishing a bench press maneuver with the handle bar and lever.

FIG. 9 illustrates the use of lever 26 and handlebar 32 for accomplishing a bench press maneuver. A conventional bench may be utilized to assist in properly locating the handle bar 32 for this maneuver.

Figure 10:
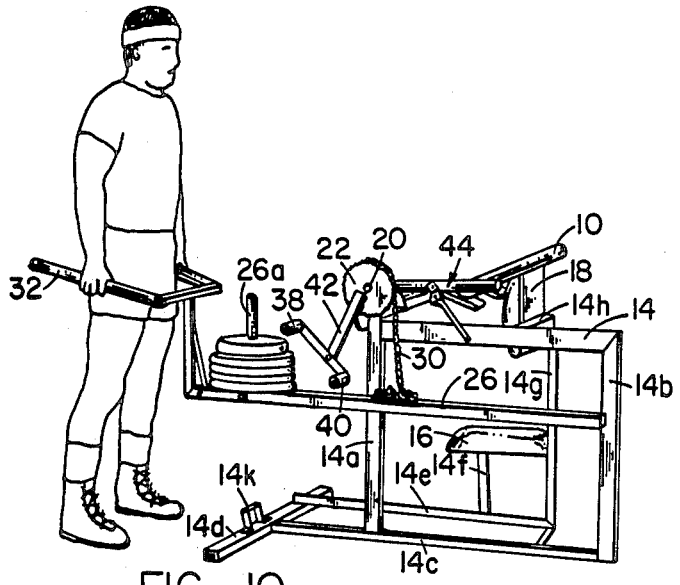
FIG. 10 is a view similar to FIG. 8 but illustrates the use of the handle bar and lever for accomplishing a shoulder lift or shrug maneuver.

FIG. 10 illustrates a shoulder lift maneuver where the lever 26 and handle bar 32 are provided to accomplish so-called shrugs.

Figure 11:
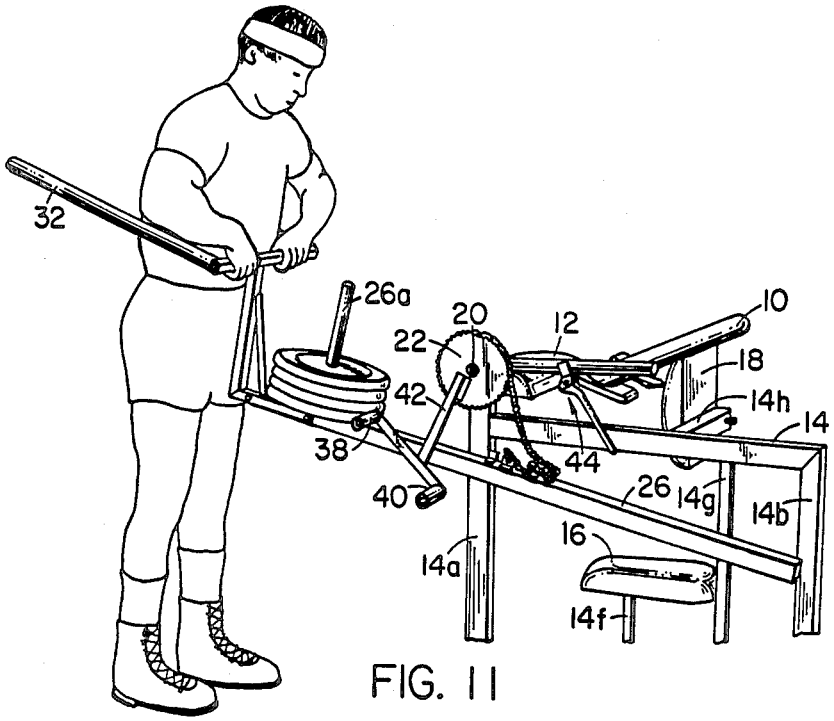
FIG. 11 is a view similar to FIGS. 8 and 10 but illustrating the use of the handle bar in accomplishing an upright rowing maneuver.

Finally, the weights on lever 26 can be raised by the handlebar to perform an upright rowing maneuver as illustrated in FIG. 11.

I claim:

1. An exercise machine comprising a frame, an operating bar pivotably mounted in said frame for movement on a first horizontal axis between first and second bar positions at least approximately 180° apart, rotatable means movable with said bar and including a peripheral portion, a tensionable flexible element having a first end connected to said peripheral portion a lever pivotably mounted in said frame on a second axis spaced from said first axis, the second end of said tensionable element connected to said lever so that rotation of said bar from a first position to a second position raises said lever from a rest position toward an elevated position, means on said lever for supporting one or more weights, eccentric weight supporting pin means coupled to said rotatable means for rotation therewith, said eccentric pin means comprising bicep and tricep pins angularly spaced relative to one another, said bicep pin located below said first axis when said bar is in its first position said tricep pin located below said first axis when said bar is in an intermediate position between said first and second positions.

2. The exercise machine of claim 1 further including a generally horizontally extending shelf provided parallel to and slightly below said first axis, said operating bar having two axially spaced manually engageable portions spaced from said first axis by approximately the length of a human forearm.

3. The exercise machine of claim 2 further including seat defining means mounted in fixed relation to said frame and provided in radially spaced relation to said first axis such that a person sitting on said seat is able to place his elbows on said shelf.

4. The exercise machine of claim 3 wherein said bar in its intermediate position is so located relative to said seat defining means that the person seated is able to place his forearms against said manually engageable portions and to pivot said bar from said intermediate toward said second position in a pushing motion that exercises at least his tricep muscles.

5. The exercise machine of claim 2 wherein said bar is U-shaped with said manually engageable portions defined on the legs of said U-shaped bar, one of said legs being pivotably mounted to said frame.

6. The exercise machine of claim 5 wherein said manually engageable portions are so located relative said shelf in the first position of said bar that a person positioned opposite said bar with his elbows on said shelf is able to grip said manually engageable portions to pivot said bar from said first position through said intermediate position to a second position in a lifting motion that exercises at least his bicep muscles.

7. The exercise machine of claim 5 further including seat defining means mounted in fixed relation to said frame and provided in radially spaced relation to said first axis such that a person sitting on said seat is able to place his elbows on said shelf.

8. The exercise machine of claim 7 wherein said bar in its intermediate position is so located relative to said seat defining means that the person seated is able to place his forearms against said manually engageable portions and to pivot said bar from said intermediate toward said second position in a pushing motion that exercises at least his tricep muscles.

9. The exercise machine of claim 8 further including a chest engageable member projecting from said shelf in a forward direction relative to said first axis, said seat defining means being spaced rearwardly relative said first axis such that the person performing such bicep and tricep exercises faces in rearward and in forward directions respectively.

10. The exercise machine of claim 7 wherein said second axis is spaced rearwardly of said first axis and wherein said lever has a free end portion extending forwardly beyond said first axis, said chain free end connected to said lever generally below said first axis.

11. The exercise machine of claim 10 wherein said weight support means on said lever comprises an upstanding post provided on said lever free end portion.

12. The exercise machine of claim 11 wherein said lever free end portion includes a forwardly projecting handle bar for use by a person in raising only those weights supported on said post on said lever free end portion, said operating bar being immobile when said handle bar is used to move said lever and said weights, on said port.

13. The exercise machine of claim 1 wherein said tensionable flexible element comprises cable means and wherein said rotatable means comprises cable receiving means rotatable on said first axis.

14. The exercise machine of claim 13 wherein said cable means comprises a chain and said cable receiving means comprises a sprocket.

* * * * *